US007721978B2

(12) United States Patent
Chevalier

(10) Patent No.: US 7,721,978 B2
(45) Date of Patent: May 25, 2010

(54) FLUID DISPENSER NOZZLE, A DISPENSER DEVICE INCLUDING SUCH A NOZZLE AND A METHOD OF FABRICATION

(75) Inventor: Marc Chevalier, Franconville (FR)

(73) Assignee: LVMH Recherche, Saint Jean de Braye (FR)

( * ) Notice: Subject to any disclaimer, the term of this patent is extended or adjusted under 35 U.S.C. 154(b) by 0 days.

(21) Appl. No.: 12/159,731

(22) PCT Filed: Dec. 22, 2006

(86) PCT No.: PCT/FR2006/002864

§ 371 (c)(1),
(2), (4) Date: Aug. 12, 2008

(87) PCT Pub. No.: WO2007/077361

PCT Pub. Date: Jul. 12, 2007

(65) Prior Publication Data

US 2008/0296318 A1 Dec. 4, 2008

(30) Foreign Application Priority Data

Jan. 2, 2006 (FR) ..... 06 00007

(51) Int. Cl.

| | |
|---|---|
| ***B05B 1/30*** | (2006.01) |
| ***B05B 1/32*** | (2006.01) |
| ***B05B 7/32*** | (2006.01) |
| ***B05B 15/06*** | (2006.01) |
| ***B05B 15/00*** | (2006.01) |
| ***B65D 25/40*** | (2006.01) |

(52) U.S. Cl. ..... 239/533.13; 239/337; 239/452; 239/533.14; 239/546; 239/602; 222/494

(58) Field of Classification Search ..... 239/337, 239/390, 451–456, 533.13, 533.14, 546, 239/602, DIG. 19; 222/491–494
See application file for complete search history.

(56) References Cited

U.S. PATENT DOCUMENTS 4,112,971 A 9/1978 Nilson et al.

(Continued)

FOREIGN PATENT DOCUMENTS

EP 0 673 852 9/1995

(Continued)

OTHER PUBLICATIONS

International Search Report; European Patent Office; Jun. 19, 2007; Form PCT/ISA/210.

(Continued)

*Primary Examiner*—Darren W Gorman
(74) *Attorney, Agent, or Firm*—Miller, MatthiaS & Hull

(57) ABSTRACT

A fluid dispenser nozzle including a resilient sealing lip fitted on a substantially rigid support, the sealing lip being adapted to bear in leaktight manner against a shutter member belonging to the support that also includes a fastener member connected to the shutter member via a movable connection, the fastener member carrying the sealing lip. The movable connection is adapted to enable the shutter member to be moved from a first position in which the shutter member is spaced apart from the sealing lip to a second position in which the shutter member bears against the sealing lip and elastically deforms the sealing lip.

16 Claims, 4 Drawing Sheets

U.S. PATENT DOCUMENTS

| | | | | |
|---|---|---|---|---|
| 4,226,342 | A * | 10/1980 | Laauwe | 222/494 |
| 4,561,570 | A * | 12/1985 | Zulauf et al. | 222/153.14 |
| 4,699,301 | A | 10/1987 | Blake et al. | |
| 6,234,363 | B1 * | 5/2001 | Stradella | 222/402.12 |

FOREIGN PATENT DOCUMENTS

| | | |
|---|---|---|
| EP | 0 713 832 | 5/1996 |
| EP | 0 905 037 | 3/1999 |
| FR | 2 785 222 | 9/2003 |
| WO | WO 97 47531 | 12/1997 |
| WO | WO 99/12845 | 3/1999 |
| WO | WO 00/26007 | 5/2000 |
| WO | WO 03/076079 | 9/2003 |
| WO | WO 2004/076308 | 9/2004 |

OTHER PUBLICATIONS

International Search Report; European Patent Office; Feb. 22, 2000; Form PCT/ISA/210.

* cited by examiner

FIG. 1
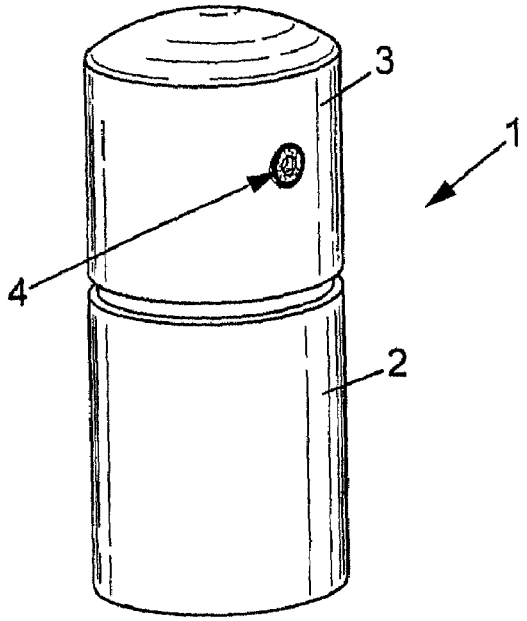
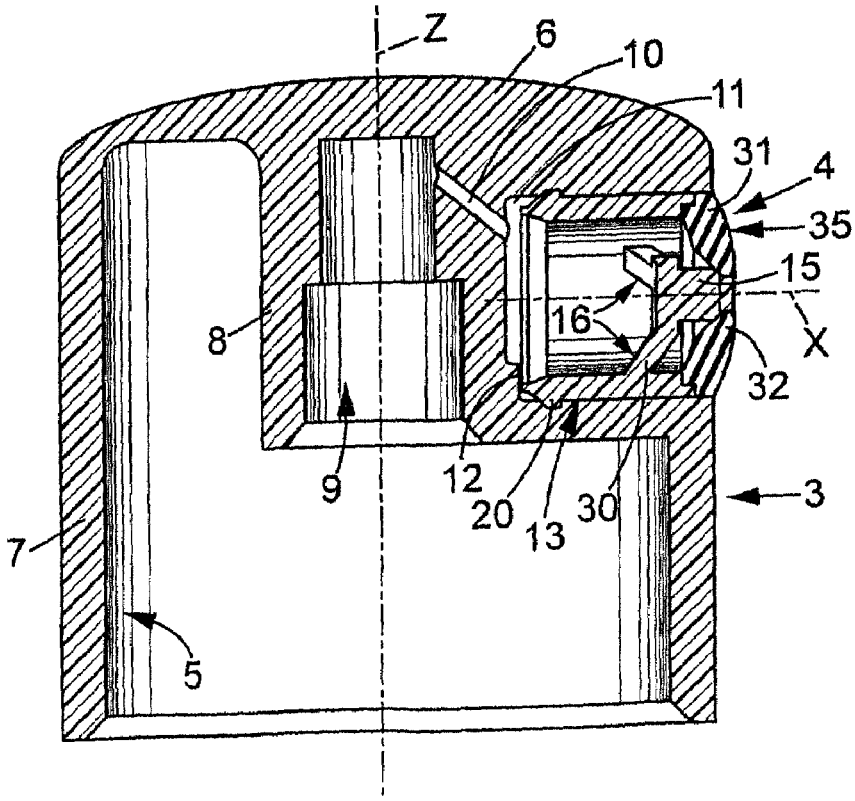
FIG. 2

FIG. 3
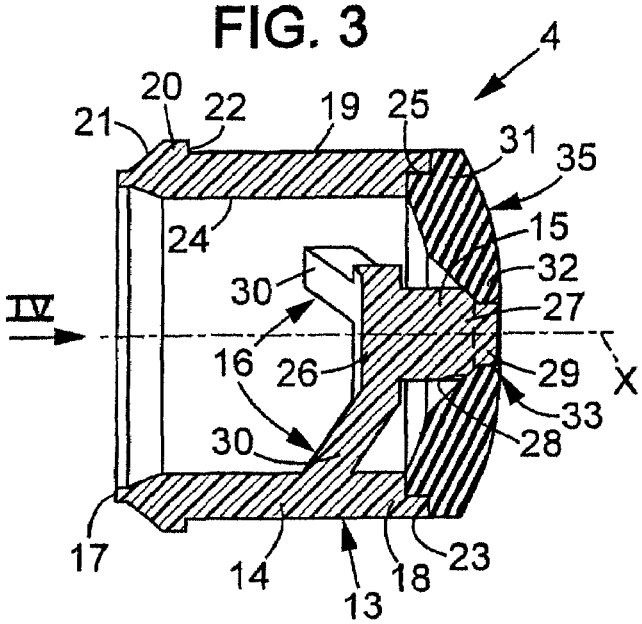
FIG. 4
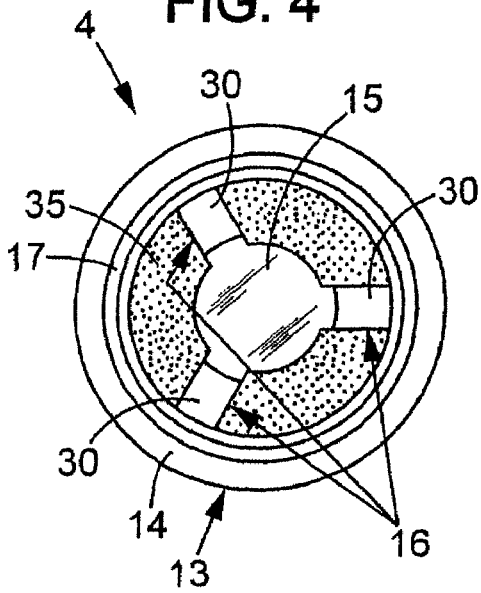
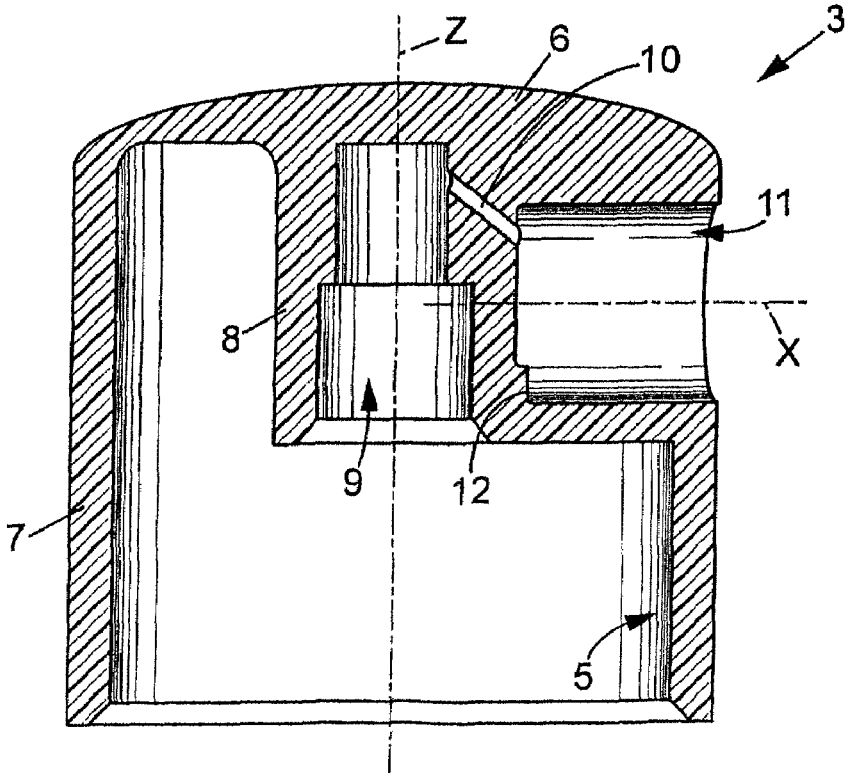
FIG. 5

FLUID DISPENSER NOZZLE, A DISPENSER DEVICE INCLUDING SUCH A NOZZLE AND A METHOD OF FABRICATION

CROSS-REFERENCE TO RELATED APPLICATION

This is a 35 USC §371 National Stage Application of International Patent Application No. PCT/FR2006/002864 filed on Dec. 22, 2006, which claims priority under the Paris Convention to French Patent Application No. FR 06 00007, filed on Jan. 2, 2006.

FIELD OF THE DISCLOSURE

The present invention relates to fluid dispenser nozzles, to dispenser devices including such nozzles, and to methods of fabricating such nozzles.

BACKGROUND OF THE DISCLOSURE

More particularly, the invention relates to a fluid dispenser nozzle comprising a resilient sealing lip fitted on a substantially rigid support, the sealing lip being adapted to press in leaktight manner against a shutter member belonging to the support, the sealing lip being pressed elastically against a free end of said shutter member.

Document WO-A-00 26007 describes an example of such a dispenser nozzle, in which the support comprises a central core having the sealing lip bearing thereagainst, which sealing lip is overmolded onto the core and surrounds said core almost completely.

The dispenser nozzle described in that document presents the following drawbacks:

- if the sealing lip adheres accidentally to the core during overmolding, then the nozzle does not operate; and
- it is not guaranteed that the sealing lip bears in leaktight manner against the core, given that the lip bears without prestress and given the possibility of shrinkage phenomena occurring during cooling of the nozzle after molding.

SUMMARY OF THE DISCLOSURE

A particular object of the present invention is to mitigate those drawbacks.

To this end, according to the invention, a dispenser nozzle of the kind in question is characterized:

- in that the support further comprises a fastener member connected to the shutter member via a movable connection, the fastener member carrying the sealing lip, the fastener member being annular and extending along a central axis between an inside end and an outside end, the shutter member extending axially inside the fastener member to said free end, and
- in that said movable connection is adapted so that the shutter member is movable from a first position in which said shutter member is spaced apart from the sealing lip, to a second position in which said shutter member bears against the sealing lip, elastically deforming said sealing lip (at least to a small extent).

By means of these dispositions, the sealing lip of the nozzle can be made on or secured to the fastener member while the shutter member is in its first position, such that said shutter member does not interfere with said making or securing of the sealing lip, thereby avoiding any risk of said sealing lip accidentally adhering to said shutter member.

Once the sealing lip is in place on the fastener member, the shutter member is moved into its second position, in such a manner that the nozzle then occupies its normal utilization configuration. The sealing lip is thus pressed elastically against the free end of the core during engagement of the support in the nozzle housing, so that there is always a certain amount of elastic prestress on the lip, thereby guaranteeing that the fluid flow passage is completely leaktight when closed. In addition, the relative positioning between the shutter member and the sealing lip is completely under control because of the movable connection, thereby further contributing to guaranteeing effective leaktight closure by the sealing lip.

In various embodiments of the invention, recourse may optionally also be had to one or more of the following dispositions:

- the movable connection is bistable, the first and second positions of the shutter member being stable positions;
- the movable connection comprises a plurality of arms distributed angularly around the shutter member and connecting said shutter member to the fastener member, each arm extending on a slant:
  - radially outwards and axially towards the inside end of the fastener member in said first position; and
  - radially outwards and axially towards the outside end of the fastener member in said first position;
- the sealing lip is annular and has a periphery fastened to the fastener member and an inner annular edge bearing elastically against an annular seat formed at the free end of the shutter member, when the shutter member is in the second position;
- said annular seat is substantially frustoconical and diverges towards the nozzle housing;
- the free end of the shutter member further includes a stud that, when the shutter member is in the second position, fills at least in part a central hole defined by the annular inner edge of the sealing lip;
- the outside end of the fastener member presents an end face facing axially outwards, and the periphery of the sealing lip is secured at least to said end face;
- the fastener member includes an inner annular surface, and the periphery of the sealing lip is secured to said inner surface at least in the vicinity of the outside end of said fastener member;
- the sealing lip is overmolded on the fastener member;
- the fastener member is made of a thermoplastic synthetic material and the sealing lip is made of a thermoelastic material that bonds naturally to said thermoplastic material;
- the fastener member is made of polybutylene terephthalate (PBT) and the sealing lip is made of liquid silicone rubber (LSR); and
- the shutter member projects from the dispenser head by a distance that is shorter than the axial movement that would be necessary to cause the shutter member to pass from the second position to the first position.

The invention also provides a fluid dispenser device, the device comprising:

- a dispenser head including a fluid flow passage opening out into an outwardly-open nozzle housing; and
- a dispenser nozzle as defined above, the fastener member being engaged in the dispenser head, and the support being engaged in said nozzle housing, the sealing lip being adapted to bear in leaktight manner against the shutter member, thereby isolating the fluid flow passage from the atmosphere so long as fluid does not arrive under pressure from said fluid flow passage.

Optionally, the fastener member may present an outer surface that is engaged in direct contact with the dispenser head as a tight fit in the nozzle housing.

Where appropriate, the dispenser head may include a bearing member that co-operates with the shutter member by coming into abutment thereagainst to prevent said shutter member from going from the second position to the first position.

Furthermore, the invention also provides a method of fabricating a fluid dispenser nozzle as defined above, and comprising at least the following steps:

a) molding the support;

b) fitting the sealing lip on the support; and c) moving the shutter member from the first position to the second position inside the fastener member.

Step b) may be a step of overmolding the sealing lip, and step c) may be performed on the support while still hot, immediately after step b).

BRIEF DESCRIPTION OF THE DRAWINGS

Other characteristics and advantages of the invention appear from the following description of two embodiments given as non-limiting examples and with reference to the accompanying drawings.

In the drawings:

FIG. 1 is a perspective view of an example of a dispenser device in a first embodiment of the invention;

FIG. 2 is a vertical section view through the dispenser head of the FIG. 1 device;

FIG. 3 is a detail axial section view of the nozzle forming part of the dispenser head of FIG. 2;

FIG. 4 is an end view of the nozzle, seen looking along arrow IV of FIG. 3;

FIG. 5 is a view similar to FIG. 2 showing the dispenser head without the nozzle;

DETAILED DESCRIPTION

Figure 6:
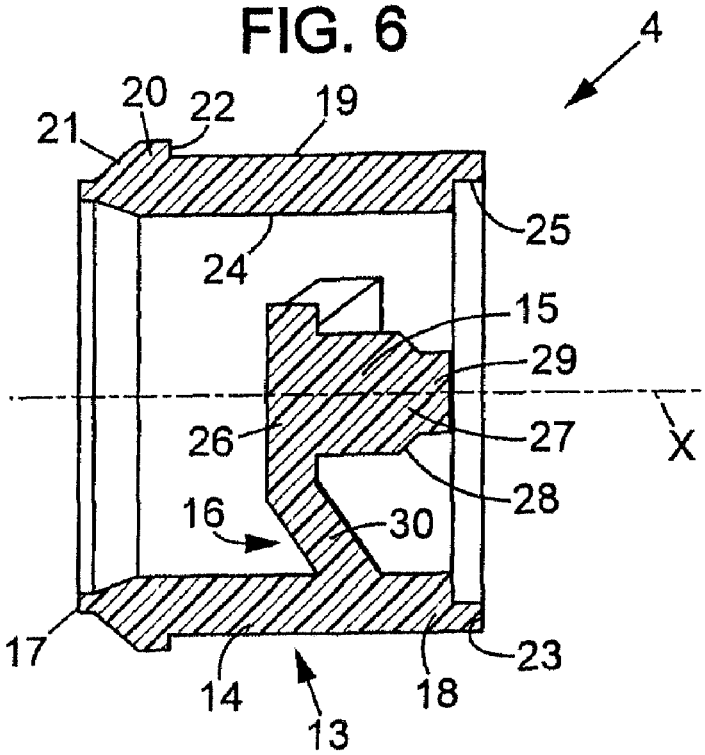
FIGS. 6 and 7 are section views similar to FIG. 3, showing the nozzle respectively before and after molding of its sealing lip, the shutter member of the nozzle then being in a first position that is different from its final position.

In the various figures, the same references are used to designate elements that are identical or similar.

FIG. 1 shows a fluid dispenser device 1, e.g. for dispensing a cosmetic or the like, and in particular having a consistency that is liquid or semi-liquid.

The dispenser device 1 comprises a reservoir 2 containing the fluid, optionally under pressure, and a dispenser head 3 carried by reservoir 2 and provided with a nozzle 4 adapted to enable the fluid to be expelled for utilization.

The dispenser head 3, shown in FIGS. 2 and 5, comprises a body 5 that may for example be molded as a single piece of thermoplastic synthetic material, in particular polypropylene or the like. The body 5 may, where appropriate, be covered in a decorative covering, made of metal or of some other substance.

The body 5 may for example include a top face 6 (slightly domed in the example described) and a substantially cylindrical skirt 7 centered on a substantially vertical axis Z. At the center of the skirt 7, the body 5 of the head may also include a tubular wall 8 that extends downwards along the axis Z from the top face to a free end, defining an internal well 9 in which it is possible, for example, to engage a hollow actuator rod of a pump or of a valve (not shown).

The well 9 communicates via a fluid flow passage 10 with a nozzle housing 11 that opens to the outside along a central axis X that may, for example, be substantially perpendicular to the axis Z (the axis X could also be inclined). The nozzle housing 11 may for example be substantially circularly cylindrical in shape, centered on the axis X. At its inside end adjacent to the tubular wall 8, the nozzle housing 11 may present at least one abutment-forming shoulder 12, for a purpose that is described below.

As shown in FIGS. 2, 3, and 4, the nozzle 4 comprises a support 13 and a sealing lip 35.

The support 13 is molded as a single piece of plastics material, in particular of thermoplastic material, e.g. polybutylene terephthalate (PBT). By way of example, the support 13 may comprise a fastener member 14 and a shutter member 15 connected to the fastener member 14 via a movable mechanical connection 16, e.g. a bistable connection.

The fastener member 14 may be annular in shape, and more particularly it may be in the form of a generally cylindrical sleeve centered on the axis X, extending between an inside end 17 and an outside end 18. The cylindrical outer surface 19 of the fastener member may present an annular rib 20 in the vicinity of its inside end 17, which rib projects radially outwards. This rib 20 may for example include a rear face 21 that converges radially inwards and towards the well 9, and a front face 22 that is substantially perpendicular to the axis X (see FIG. 3). The outside edge 18 of the fastener member 14 may present an end face 23 that is substantially perpendicular to the axis X, and in the vicinity of said end face 23, the cylindrical inside surface 24 of the fastener member may present an enlarged angular portion 25.

The shutter member 15 may be in the form of a core of plastics material presenting circular symmetry about the axis X and extending axially between a base 26 and a free end 27 that may for example present an annular seat 28 suitable for being formed in particular by a frustoconical surface, the annular seat 28 possibly being extended axially outwards by a stud 29.

The bistable mechanical connection that connects the fastener member 14 to the shutter member 15 may be a toggle connection 16, comprising a plurality of arms 30 connecting the shutter member to the fastener member. The arms 30 may be molded integrally with the shutter member and the fastener member, and the arms may be distributed angularly around the shutter member 15 (there being three arms 30 that are distributed angularly at 120° from one another in the example described).

Figure 7:
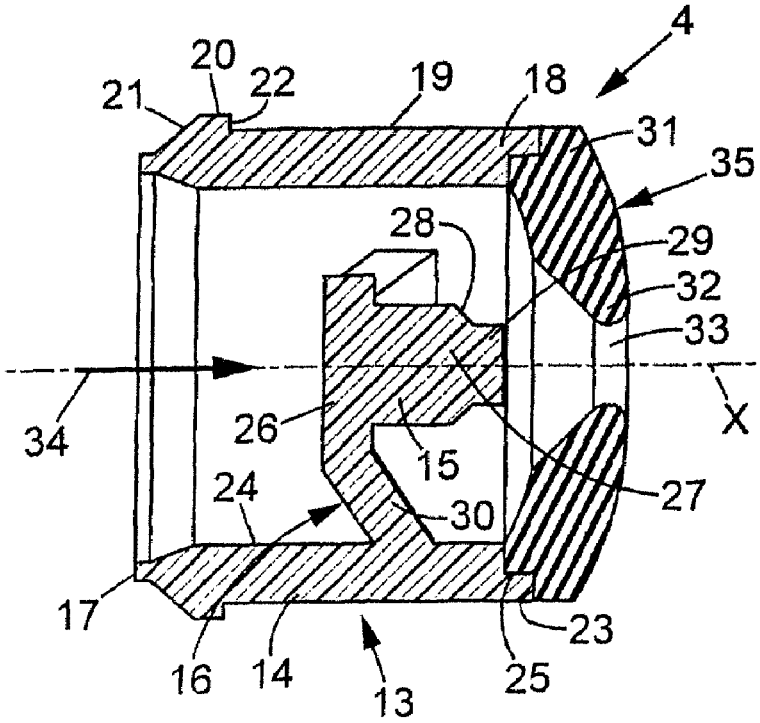

The bistable connection 16 serves to allow the shutter member 15 to move between first and second stable positions comprising:

- a first position shown in FIG. 7, enabling the lip 14 to be molded in the manner described below: in this position, each of the arms 30 can extend in a substantially radial plane from the base 26 of the shutter member, slanting radially outwards and axially towards the outside end 18 of the fastener member, to the inside surface 24 of said shutter member; and
- a second position or utilization position, as can be seen in particular in FIG. 3, where each arm 30 can extend in a plane that is substantially radial from the base 26 of the shutter member, radially outwards and axially towards the inside end 17 of the fastener member, to the inside surface 24 of the fastener member.

It should be observed that in the second position, the shutter member 15 can project from the dispenser head 3 (see FIG.

2) by a distance that is shorter than the axial displacement needed to cause the bistable connection 16 to go from its second position to its first position by pressing against said shutter member from outside the head, thereby guaranteeing that the shutter member remains in place throughout the lifetime of the device.

As shown in FIGS. 2 and 3, the sealing lip 35 may be overmolded onto the end face 23 and onto the enlarged portion 25 of the inside surface of the fastener member. The sealing lip 35 may be made of an elastomer (a thermoelastic material) selected so that said sealing lip 35 adheres naturally to the material of the support 13 merely as the result of being molded thereon. By way of example, the lip 35 may be made of liquid silicone rubber (LSR).

In the example described herein, the sealing lip 35 is in the form of an annular body of revolution about the axis X, the periphery 31 of said sealing lip being overmolded onto the above-mentioned end face 23 and enlarged portion 25, and the annular inside edge 32 of said sealing lip pressing resiliently against the annular seat 28 of the shutter member 15 when the shutter member is in its second position. In this position, the central hole 32 left empty in the center of the annular inside edge 32 of the sealing lip can be substantially filled by the stud 29 of the shutter member, thereby preventing any fluid stagnating and drying out in said hole between two utilizations.

During the process of fabricating the nozzle 4, the support 13 is initially molded with the bistable connection 16 in its first position, as shown in FIG. 6.

Thereafter, the sealing lip 35 is molded onto the support 13, preferably in the same mold device that was used for molding the support 13, using a conventional dual injection method. During unmolding, the base 26 of the shutter member is pressed in the direction of arrow 34 (see FIG. 7), so as to cause the shutter member 15 to pass from its first position to its second position, as shown in FIG. 3. The shutter member 15 then deforms the peripheral inside edge 32 of the lip elastically to a small extent, thereby providing sealing contact with elastic prestress of said lip against the above-mentioned annular seat 28.

This movement of the shutter member 15 with the bistable connection 16 going between its first and second positions can be made easier by the fact that the plastics material constituting the support 13 is still hot (particularly since the thermoelastic material of the lip 35 is generally hot-molded): the arms 30 forming the bistable connection 16 are thus subjected to plastic deformation during this movement.

It should be observed that the mold used for molding the sealing lip 35 may include an internal insert (not shown) having a central rod that passes through the hole 33 and an enlarged head that corresponds to the inside shape of the sealing lip 35. During unmolding, the insert is withdrawn through the central hole 33 of the sealing lip which is thus elastically expanded as the enlarged head of the insert passes therethrough.

After the nozzle 4 has been made in full, the support 13 is engaged as a tight fit in the nozzle housing 11, the outside surface 19 of the fastener member 14 coming into direct contact with the body 5 of the head. During this engagement, the annular rib 20 deforms the material of the body 5 of the head locally since said material is more flexible than the material of the support 13. This engagement movement is made easier by the slanting profile of the rear face 21 of the rib 20.

When the rear end 17 of the support member 14 comes into abutment against the shoulder 12 of the housing 11, the rib 20 becomes anchored in the material of the body 5, thereby guaranteeing that the nozzle 4 is completely prevented from moving.

The above-described device operates as follows: at rest, the sealing lip 35 hermetically closes the nozzle housing 11, the fluid flow passage 10, and the well 9, thereby preventing the fluid from drying out inside the dispenser head 3. When the user presses manually on the head 3, that moves the hollow rod of the pump or the valve mounted on the reservoir 2, thereby causing fluid to be expelled under pressure into the well 9, the passage 10, and the nozzle housing 11, such that the annular inside edge 32 of the sealing lip moves elastically away from the seat 28 of the shutter member, thereby allowing the fluid to go past. At the end of fluid expulsion, the sealing lip 35 immediately presses once more against the shutter member 15.

Figure 8:
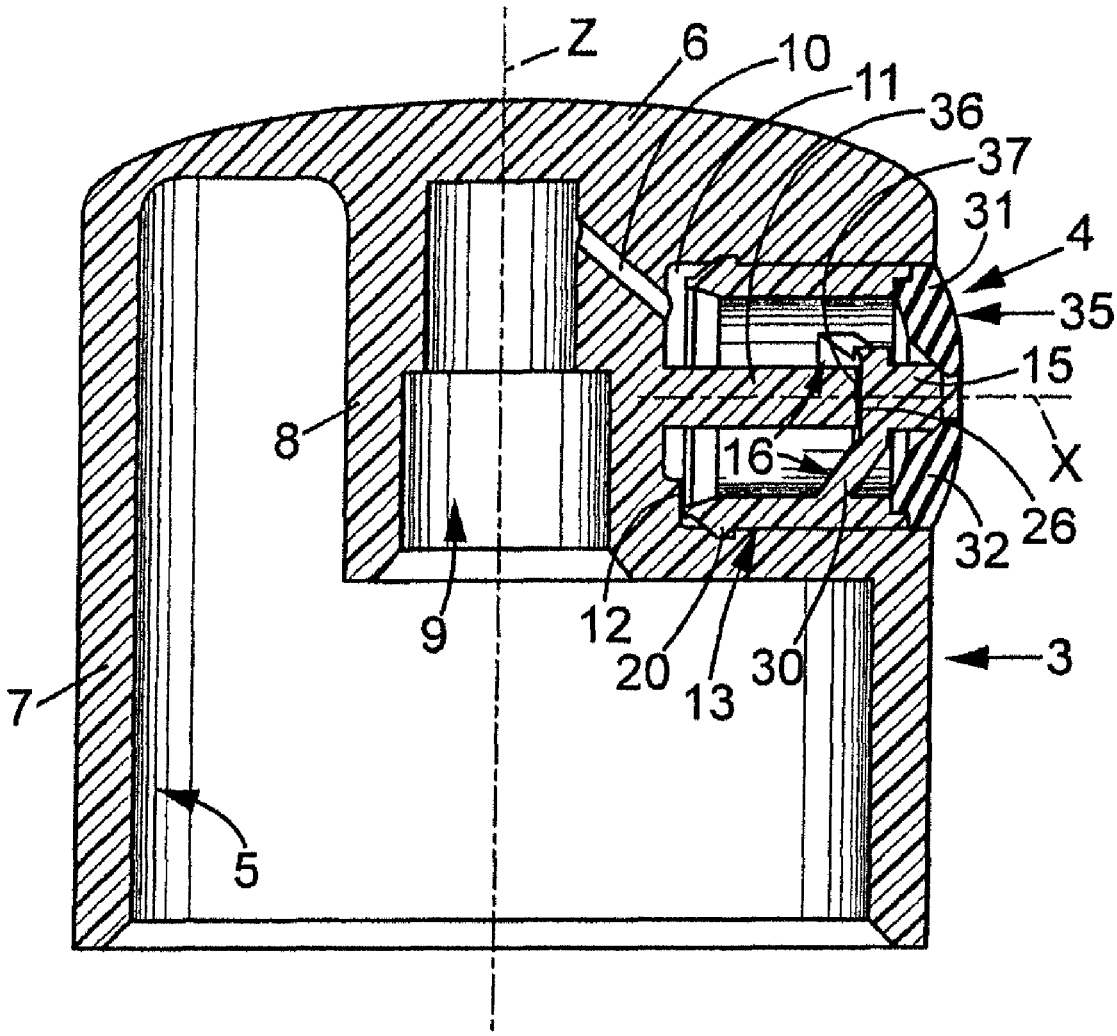
FIG. 8 is a view similar to FIG. 2 in a second embodiment of the invention.

In the second embodiment of the invention as shown in FIG. 8, the dispenser device is similar to the above-described device and is therefore not described in detail herein. This dispenser device differs from the above-described device by the fact that the dispenser head 3 includes a bearing member 36 that may for example be in the form of a cylindrical or conical rod extending along the axis X inside the nozzle housing 11 from the inside end of said nozzle housing to an end face 17 that is in contact with the base 26 of the shutter member 15 or that is in the vicinity thereof. The bearing member prevents the shutter member 15 from being able to pass from its second position to its first position once the nozzle is in place on the dispenser head. In addition, and where appropriate, the bearing member 36 can also serve to cause the shutter member 15 to go from its first position to its second position during assembly of the nozzle 4 with the head 3.

The invention claimed is:

1. A fluid dispenser nozzle comprising a resilient sealing lip fitted on a substantially rigid support, the sealing lip being adapted to press in leaktight manner against a shutter member belonging to the support, the sealing lip being pressed elastically against a free end of said shutter member, comprising:

a fastener member connected to the shutter member via a movable connection, the fastener member carrying the sealing lip, the fastener member being annular and extending along a central axis between an inside end and an outside end, the shutter member extending axially inside the fastener member to said free end, wherein said movable connection is adapted so that the shutter member and said movable connection are movable from a first position in which said shutter member is spaced apart from the sealing lip, to a second position in which said shutter member bears against the sealing lip, elastically deforming said sealing lip, and wherein the movable connection is bistable and adapted to stably retain said shutter member in said first and second positions when said shutter member is not subject to outside forces.

2. A fluid dispenser nozzle comprising a resilient sealing lip fitted on a substantially rigid support, the sealing lip being adapted to press in leaktight manner against a shutter member belonging to the support, the sealing lip being pressed elastically against a free end of said shutter member, wherein the support further comprises a fastener member connected to the shutter member via a movable connection, the fastener member carrying the sealing lip, the fastener member being annular and extending along a central axis between an inside end and an outside end, the shutter member extending axially inside the fastener member to said free end, wherein said movable connection is adapted so that the shutter member is movable from a first position in which said shutter member is spaced apart from the sealing lip, to a second position in which said shutter member bears against the sealing lip, elastically deforming said sealing lip, and wherein the movable connection comprises a plurality of arms distributed angularly around the shutter member and connecting said shutter member to the fastener member, each arm extending on a slant:

radially outwards and axially towards the inside end of the fastener member in said first position; and radially outwards and axially towards the outside end of the fastener member in said first position.

3. A nozzle according to claim 1, in which the sealing lip is annular and has a periphery fastened to the fastener member and an inner annular edge bearing elastically against an annular seat formed at the free end of the shutter member, when the shutter member is in the second position.

4. A nozzle according to claim 3, in which said annular seat is substantially frustoconical and diverges opposite the free end of the shutter member.

5. A nozzle according to claim 3, in which the free end of the shutter member further includes a stud that, when the shutter member is in the second position, fills at least in part a central hole defined by the annular inner edge of the sealing lip.

6. A nozzle according to claim 1, in which the outside end of the fastener member presents an end face facing axially outwards, and a periphery of the sealing lip is secured at least to said end face.

7. A nozzle according to claim 1, in which the fastener member includes an inner annular surface, and a periphery of the sealing lip is secured to said inner surface at least in the vicinity of the outside end of said fastener member.

8. A nozzle according to claim 1, in which the sealing lip is overmolded on the fastener member.

9. A nozzle according to claim 8, in which the fastener member is made of a thermoplastic synthetic material and the sealing lip is made of a thermoelastic material that bonds naturally to said thermoplastic material.

10. A nozzle according to claim 9, in which the fastener member is made of polybutylene terephthalate (PBT) and the sealing lip is made of liquid silicone rubber (LSR).

11. A nozzle according to claim 1, in which the shutter member projects from a dispenser head by a distance that is shorter than the axial movement that would be necessary to cause the shutter member to pass from the second position to the first position.

12. A fluid dispenser device comprising:

a dispenser head including a fluid flow passage opening out into an outwardly-open nozzle housing; and a dispenser nozzle according to claim 1, the fastener member being engaged in the dispenser head, and the support being engaged in said nozzle housing, the sealing lip being adapted to bear in leaktight manner against the shutter member, thereby isolating fluid flow passage from the atmosphere so long as the fluid does not arrive under pressure from said fluid flow passage.

13. A device according to claim 12, in which the fastener member presents an outer surface that is engaged in direct contact with the dispenser head as a tight fit in the nozzle housing.

14. A fluid dispenser device comprising:

a dispenser head including a fluid flow passage opening out into an outwardly-open nozzle housing; and a dispenser nozzle comprising a resilient sealing lip fitted on a substantially rigid support, the sealing lip being adapted to press in leaktight manner against a shutter member belonging to the support, the sealing lip being pressed elastically against a free end of said shutter member, wherein the support member comprises a fastener member connected to the shutter member via a movable connection, the fastener member carrying the sealing lip, the fastener member being annular and extending along a central axis between an inside end and an outside end, the shutter member extending axially inside the fastener member to said free end, wherein said movable connection is adapted so that the shutter member and said movable connection are movable from a first position in which said shutter member is spaced apart from the sealing lip, to a second position in which said shutter member bears against the sealing lip, elastically deforming said sealing lip, wherein the movable connection is bistable and adapted to stably retain said shutter member in said first and second positions when said shutter member is not subject to outside forces, wherein the fastener member being engaged in the dispenser head, and the support being engaged in said nozzle housing, the sealing lip being adapted to bear in leaktight manner against the shutter member, thereby isolating fluid flow passage from the atmosphere so long as the fluid does not arrive under pressure from said fluid flow passage, and wherein the dispenser head includes a bearing member that co-operates with the shutter member by coming into abutment thereagainst to prevent said shutter member from going from the second position to the first position.

15. A method of fabricating a fluid dispenser nozzle comprising a resilient sealing lip fitted on a substantially rigid support, the sealing lip being adapted to press in leaktight manner against a shutter member belonging to the support, the sealing lip being pressed elastically against a free end of said shutter member, wherein the support further comprises a fastener member connected to the shutter member via a movable connection, the fastener member carrying the sealing lip, the fastener member being annular and extending along a central axis between an inside end and an outside end, the shutter member extending axially inside the fastener member to said free end, wherein said movable connection is adapted so that the shutter member and said movable connection are movable from a first position in which said shutter member is spaced apart from the sealing lip, to a second position in which said shutter member bears against the sealing lip, elastically deforming said sealing lip, and wherein the movable connection is bistable and adapted to stably retain said shutter member in said first and second positions when said shutter member is not subject to outside forces, said method comprising at least the following steps:

a) molding the support;

b) fitting the sealing lip on the support; and c) moving the shutter member from the first position to the second position inside the fastener member.

16. A method according to claim 15, in which step b) is a step of overmolding the sealing lip, and step c) is performed on the support while still hot, immediately after step b).

* * * * *